US007673811B2

(12) United States Patent
Schuster et al.

(10) Patent No.: US 7,673,811 B2
(45) Date of Patent: Mar. 9, 2010

(54) INJECTION VALVE AND COMPENSATING ELEMENT FOR AN INJECTION VALVE

(75) Inventors: Stefan Schuster, Regensburg (DE); Willibald Schürz, Pielenhofen (DE); Martin Simmet, Bad Abbach (DE); Hanspeter Zink, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 871 days.

(21) Appl. No.: 11/446,719

(22) Filed: Jun. 5, 2006

(65) Prior Publication Data

US 2007/0028613 A1 Feb. 8, 2007

(30) Foreign Application Priority Data

Jun. 6, 2005 (DE) ..... 10 2005 025 953

(51) Int. Cl.
*B05B 1/08* (2006.01)

(52) U.S. Cl. ..... 239/102.2; 239/584; 251/129.06

(58) Field of Classification Search ..... 251/129.06; 310/346; 277/543, 548, 589; 403/225, 221, 403/243; 239/102.2, 584
See application file for complete search history.

(56) References Cited

U.S. PATENT DOCUMENTS 5,303,906 A * 4/1994 Cotter et al. ..... 267/64.11
5,380,016 A * 1/1995 Reinsma et al. ..... 277/503
6,454,239 B1 * 9/2002 Boecking ..... 251/129.06
6,685,105 B1 * 2/2004 Ruehle et al. ..... 239/102.1
6,766,965 B2 * 7/2004 D'Arrigo ..... 239/102.2
6,805,329 B2 * 10/2004 Kegel ..... 251/57
6,820,820 B1 * 11/2004 Boecking ..... 239/102.2
7,309,027 B2 * 12/2007 Magel et al. ..... 239/88
7,419,103 B2 * 9/2008 Pauer ..... 239/88
7,455,244 B2 * 11/2008 Boecking ..... 239/102.2
7,484,673 B2 * 2/2009 Boecking ..... 239/88
7,500,648 B2 * 3/2009 Kammerer et al. ..... 251/57
2002/0056768 A1 * 5/2002 Czimmek ..... 239/585.1
2002/0139863 A1 * 10/2002 Lorraine et al. ..... 239/5
2003/0150939 A1 * 8/2003 Lorraine et al. ..... 239/533.2
2004/0031862 A1 * 2/2004 Eichendorf ..... 239/102.2

(Continued)

FOREIGN PATENT DOCUMENTS

DE 10332088 7/2003

(Continued)

*Primary Examiner*—John K Fristoe, Jr.
*Assistant Examiner*—Marina Tietjen
(74) *Attorney, Agent, or Firm*—King & Spalding L.L.P.

(57) ABSTRACT

A compensating element (30) for an injection valve has a cup-shaped body (32) with a cup base (34) and a recess. Furthermore, the compensating element has a piston (36) which makes a clearance fit in respect of the recess of the cup-shaped body (32) on an axially extending guide segment (41) of the piston (36) and which is arranged at least partially axially moveable with the guide segment (41) in the recess of the cup-shaped body (32). A sealing element (44) is arranged on the side of the guide segment (41) facing away from the cup base (32) and couples the cup-shaped body (32) with the piston (36). A hydraulically and/or pneumatically sealed system is delimited by the cup-shaped body (32), the piston (36) and the sealing element (44). The coupling of the sealing element (44) with the cup-shaped body (32) and/or the piston (36) is friction-fit.

16 Claims, 3 Drawing Sheets

U.S. PATENT DOCUMENTS

2004/0173694 A1* 9/2004 Cooke ..... 239/102.2
2004/0237519 A1* 12/2004 Schurz ..... 60/553

FOREIGN PATENT DOCUMENTS

DE 102 33 907 A1 2/2004
DE 103 60 450 A1 9/2004
DE 10344061 A1 4/2005
EP 1391608 A1 2/2004
WO 2005031152 A1 4/2005

* cited by examiner

INJECTION VALVE AND COMPENSATING ELEMENT FOR AN INJECTION VALVE

PRIORITY

This application claims priority from German Patent Application No. DE 10 2005 025 953.7, which was filed on Jun. 6, 2005, and is incorporated herein by reference in its entirety.

TECHNICAL FIELD

The invention relates to a compensating element for an injection valve comprising a cup-shaped body with a cup base and a recess in which a piston is arranged in an axially moveable fashion. The invention further relates to an injection valve.

BACKGROUND

Ever more strict legal specifications relating to the admissible exhaust emissions from internal combustion engines arranged in motor vehicles necessitate various measures being carried out, by means of which exhaust emissions are reduced. A starting point here is to reduce the toxic emissions generated by the internal combustion engine. The generation of exhaust emissions is heavily dependent on the preparation of the air/fuel mixture in the respective cylinder of the internal combustion engine. A very precise dosing of fuel in a combustion chamber of the internal combustion engine contributes to a very low generation of exhaust emissions.

DE 103 44 061 A1 discloses an injection valve with a hydraulic compensating element. When the injection valve is used, particularly in an engine, any play which exists must be compensated for. In this case, the compensation mechanism for the play can be created by creating a closed hydraulic system and creating an upper operating volume above a piston and a lower operating volume below the piston. Any pressure difference which may occur between the upper and the lower operating volumes is then compensated for by a joining gap, if the pressure difference builds up slowly.

SUMMARY

The object of the invention is to create an injection valve and a compensating element for an injection valve, which can be manufactured easily and easily allows a precise dosing of fuel in a combustion chamber of an internal combustion engine.

The invention is characterized by an injection valve and a compensating element for the injection valve. The compensating element features a cup-shaped body with a cup base and a recess. The compensating element further comprises a piston which features a clearance fit in relation to the recess of the cup-shaped body on an axially extending guide segment of the piston. The piston is arranged at least partially axially moveable with the guide segment in the recess of the cup-shaped body. A sealing element is arranged on the side of the guide segment facing away from the cup base and couples the cup-shaped body with the piston. A hydraulically and/or pneumatically sealed system is delimited by the cup-shaped body, the piston and the sealing element. The coupling of the sealing element with the cup-shaped body and/or the piston is frictional.

The friction-fit coupling of the sealing element with the cup-shaped body and/or the piston can be manufactured in a very simple and cost-effective manner. Furthermore, only very negligible heat is generated when the sealing element is mounted onto the cup-shaped body and/or the piston. This allows a multiplicity of design options for the construction of the sealing element and a large choice of materials for the compensating element.

In an advantageous embodiment of the compensating element, the sealing element comprises an outer ring and an inner ring. The outer ring and the inner ring are coupled with one another by means of a sealing ring. The sealing ring exhibits a greater elasticity than the outer ring and the inner ring. A relatively inelastic inner and outer ring, which comprise a metal for instance, allow a simple friction-fit coupling between the inner ring and piston and/or the outer ring and the cup-shaped body. A relatively elastic sealing ring allows the formation of a hydraulically and/or pneumatically sealed system at the same time as allowing movement of the piston.

In a further advantageous embodiment of the compensating element, the outer ring and/or the cup-shaped body comprises at least one first outer protrusion in a cylindrical outer coupling area. In the outer coupling area, the sealing element is coupled with the cup-shaped body. The first outer protrusion extends around the entire circumference of the outer coupling area. Furthermore, the first outer protrusion comprises a tight fit in respect of the cup-shaped body and/or of the outer ring in the coupling area. The outer ring and/or the cup-shaped body are fixed on the basis of the tight fit to the cup-shaped body and/or to the outer ring. The tight fit of the first outer protrusion simply allows a friction-fit and sealed coupling of the outer ring with the cup-shaped body.

In a further advantageous embodiment of the compensating element, the outer ring and/or the cup-shaped body in the outer coupling area features a second outer protrusion. The second outer protrusion extends around the entire circumference of the outer coupling area. The second outer protrusion comprises a larger oversize in respect of the cup-shaped body and/or of the outer ring in the coupling area than the first outer protrusion. Furthermore, the second outer protrusion in the axial direction is embodied to be displaced at the first outer protrusion such that when the outer ring is mounted onto the cup-shaped body, the first outer protrusion is first coupled with the cup-shaped body and/or the outer ring and then the second outer protrusion. The second outer protrusion simply contributes to a friction-fit and sealed coupling.

In a further advantageous embodiment of the compensating element, the inner ring and/or the piston in a cylindrical inner coupling area comprises at least a first inner protrusion. The sealing element is coupled with the piston in the inner coupling area. The first inner protrusion extends around the entire circumference of the inner coupling area. Furthermore, the first inner protrusion makes an oversize fit in respect of the piston and/or the inner ring in the coupling area. The inner ring and/or the piston are fixed on the basis of the oversize fit to the piston and/or on the inner ring. The oversize fit of the first inner protrusion allows a friction-fit coupling of the inner ring with the piston in a simple manner.

In a further advantageous embodiment of the compensating element, the inner ring and/or the piston in the inner coupling area comprises a second inner protrusion. The second inner protrusion extends around the entire circumference of the inner coupling area. Furthermore, the second inner protrusion comprises a greater oversize in respect of the piston and/or of the inner ring in the coupling area than the first inner protrusion. The second inner protrusion is embodied to be offset in an axial direction from the first inner protrusion such that when the inner ring is mounted onto the piston, the first inner protrusion is first coupled to the piston and/or the inner ring and then the second inner protrusion. The second inner protrusion simply contributes to the friction-fit and sealed coupling.

In a further advantageous embodiment of the compensating element, the first and/or the second outer protrusion and/or the first and/or the second inner protrusion are embodied to have a rounded profile. The round design theoretically generates a punctiform contact surface. This easily allows a plastic deformation of the protrusions and of the cup-shaped body and/or of the piston in the coupling areas and thus a friction-fit coupling. Furthermore, a round design of the protrusions allows a simple assembly.

In a further advantageous embodiment of the compensating element, the piston comprises a piston rod and a piston head which comprises the guide segment. The piston rod protrudes out from the recess of the cup-shaped body such that its axial end facing away from the piston head is outside the sealed system. This contributes to the compensatory effect of the compensating element in a simple manner.

In a further advantageous embodiment of the compensating element, the inner ring is coupled with the piston rod. The entire surface of the piston head facing the piston rod is available as a hydraulically effective surface. This contributes to the compensatory effect of the compensating element in a simple manner.

In a further advantageous embodiment of the compensating element, the sealed ring features an elastomer. This gives the sealing ring good pressure load resistance combined with good expansion properties.

BRIEF DESCRIPTION OF THE DRAWINGS

Exemplary embodiments of the invention are described below with reference to the schematic drawings, in which.

Elements of the same construction or function are identified overall in the figures with the same reference characters.

DETAILED DESCRIPTION

Figure 1:
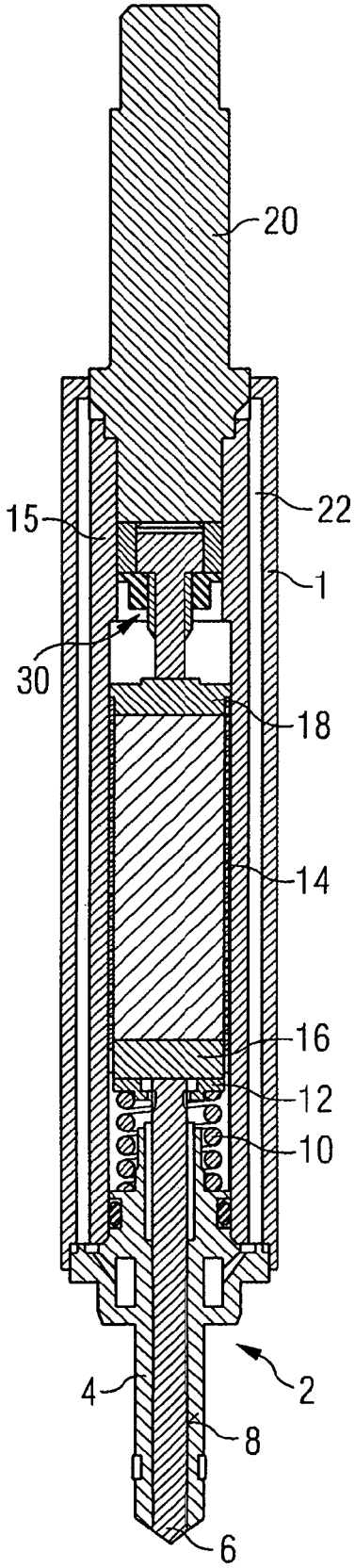
FIG. 1 shows an injection valve

An injection valve (FIG. 1) comprises a housing 1, a nozzle assembly 2 and an actuator. The injection valve is preferably designed as a fuel injection valve for injecting fuel into a combustion chamber of an internal combustion engine. The housing 1 of the injection valve can be embodied as a double tube design.

The nozzle assembly 2 comprises a nozzle body 4 with a recess and a nozzle needle 6, which is arranged in the recess of the nozzle body 4 in an axially moveable fashion. In the area of a guide 8, the nozzle needle 6 is guided into the recess of the nozzle body 4. In a closed position of the nozzle needle 6, the nozzle needle 6, in conjunction with the nozzle body 4, prevents a fluid flow through an injection port. The injection port is formed outside the closed position of the nozzle needle 6 by means of a cylindrical gap between the nozzle needle 6 and the nozzle body 4, through which the fuel can be dosed into the combustion chamber of the internal combustion machine. With an injection valve opening inwards, the injection port can be formed for instance by one or a number of injection holes in the nozzle body 4. A nozzle spring 10 prestresses the nozzle needle 6 via a spring plate 12 in the direction towards the actuator, which is preferably designed as a piezo actuator 14. This means that the injection port is closed when the piezo actuator 14 is not activated.

The piezo actuator 14 operates via the base plate 16 on the nozzle needle 6. A cover plate 18 is arranged on the side of the piezo actuator 14 facing away from the base plate 16. The cover plate 18 is coupled with a compensating element 30 which supports the side of the compensating element 30 facing away from the cover plate 18 on a terminal 20. The terminal 20 can comprise a number of supply lines, bores and recesses which are suitable for instance for supplying fuel into the injection valve or for accommodating electrical lines for routing electrical signals to the piezo actuator 14 for instance. A fuel feed 22 is formed by the space between the housing 1 and the inner tube 15. Alternatively, the fuel can also be fed into the injection port via a recess in the housing 1 and/or the nozzle assembly 2.

The position of the nozzle needle 6 is determined by the forces which the nozzle spring 10 and the piezo actuator 14 exert on the nozzle needle 6. Provided the force exerted by the piezo actuator 14 on the nozzle needle 6 is lower than the forces exerted by the nozzle spring 10 on the nozzle needle 6, the injection port is closed and a dosing of fuel is prevented. As soon as the force exerted by the piezo actuator 14 on the nozzle needle 6 is greater than the force exerted by the nozzle spring 10 on the nozzle needle, the nozzle needle 6 is pushed in the direction away from the piezo actuator 14 and thus releases the injection opening.

The expansion of the piezo actuator 14 is controlled by the voltage applied to it. The electrical energy deposited in the piezo actuator 14, in particular the deposited electrical charges, is representative here for the expansion of the piezo actuator 14. Additionally, the expansion of the piezo actuator 14 is determined by its temperature. The greater the temperature of the piezo actuator 14, the greater its expansion. Since, as a result of temperature fluctuations, the expansion of the piezo actuator 14 is in the order of magnitude of the expansion based on the deposited electrical charges, it must be ensured that the injection valve also functions accurately at different temperatures. For this purpose, the piezo actuator 14 is arranged in the housing in an axially moveable fashion and is coupled with the compensating element 30.

Figure 2:
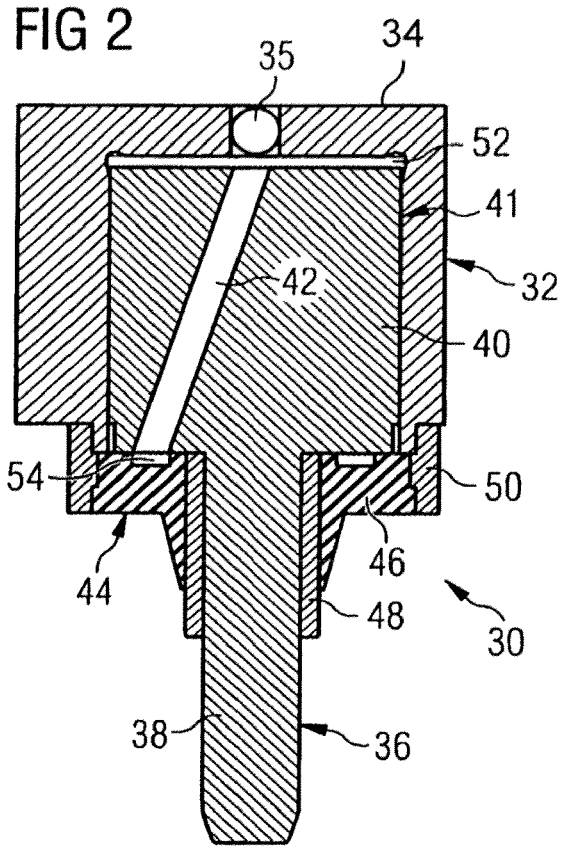
FIG. 2 shows a compensating element for the injection valve.

The compensating element 30 (FIG. 2) comprises a cup-shaped body 32. The cup-shaped body 32 comprises a cup base 34 and cup wall, which laterally restricts the recess in the cup-shaped body 32. The cup base 34 preferably comprises a recess which is closed for instance by a closure ball 35. A piston 36 is arranged in the recess of the cup-shaped body 32 in an axially moveable fashion. The piston 36 preferably comprises a piston rod 38 and a piston head 40. The piston head 40 comprises a guide segment 41. In the guide segment 41, the piston bead 40 makes a clearance fit in respect of the recess in the cup-shaped body 32. The clearance fit allows the piston 36 to be guided in the recess of the cup-shaped body 32. A piston recess 42 extends at least partially in an axial direction from the side of the piston head 40 facing the cup base 34, back to the side of the piston head 40 facing away from the cup base 34. The piston 35 is coupled with the cup-shaped body 32 via a sealing element 44. The sealing element 44 is preferably coupled with the piston rod 38. The sealing element 44 preferably comprises an inner ring 48 and an outer ring 50 which are coupled with one another via a sealing ring 46. The material of the sealing ring 46 is designed to be relatively elastic in comparison with the material of the inner ring 48 and of the outer ring 50. By way of example, the sealing ring 46 can comprise an elastomer and the inner and/or outer ring can comprise a metal for instance. The elasticity module of the material for the sealing ring can be smaller than 10 GPa for instance and the elasticity module of the material for the inner and outer ring 48, 50 can be greater than 10 GPa.

A first operating volume 52 is formed between the piston head 40 and the cup base 34. A second operating volume 54 is formed between the sealing ring 46 and the piston head 40. The first operating volume 52 communicates with the second operating volume 54 through the piston recess 42 and/or suitable choice of the clearance fit between the guide segment 41 and the cup wall of the cup-shaped body 32. During the assembly of the compensating element 30, the piston 36 can be inserted into the cup-shaped body 32 and coupled with the cup-shaped body 32 via the sealing element 44. The inner ring and/or the outer ring 48, 50 are preferably coupled here with the piston 36 and/or the cup-shaped body 32 by means of an oversize fit. A gas-free oil is poured into the first and second operating volume 52, 54 via the recess in the cup base 34. With a complete operating volume 52, 54, the recess in the cup base 34 is preferably closed by the closure ball 35, which comprises an oversize fit in respect of the recess in the cup base 34. The sealing element 44, the piston 36 and the cup-shaped body 32 thus form a hydraulically sealed system.

The piston 36 is prestressed in the direction away from the cup-base 34 through the oil pressure in the first operating volume 52 on the basis of the larger surface of the piston head 40 on the side of the piston head 40 facing the cup-base 34, in comparison with the surface of the side of the piston head 40 facing away from the cup base. The piston recess 42 and/or the clearance fit between the piston head 40 and the cup wall of the cup-shaped body 32 are dimensioned such that with a slow movement of the piston 36 in the direction towards the cup base 34, provoked for instance by a thermal expansion of the piezo actuator 14, an exchange of oil between the first operating volume 52 and the second operating volume 54 is easily possible. The thermal expansion of the piezo actuator 14 is thus compensated by the compensating element 30. If the piezo actuator 14 is however electrically controlled to open the injection port, it thus quickly expands in the order of magnitude of microseconds for instance. With a rapid expansion of this type, a pressure equalization via the clearance fit or the piston recess 42 is not possible in a sufficiently quick manner and the compensating element 30 functions overall like a rigid body. In this way, the force with which the piezo actuator 14 expands is transmitted to the nozzle needle 6 thereby releasing the injection port.

Figure 3:
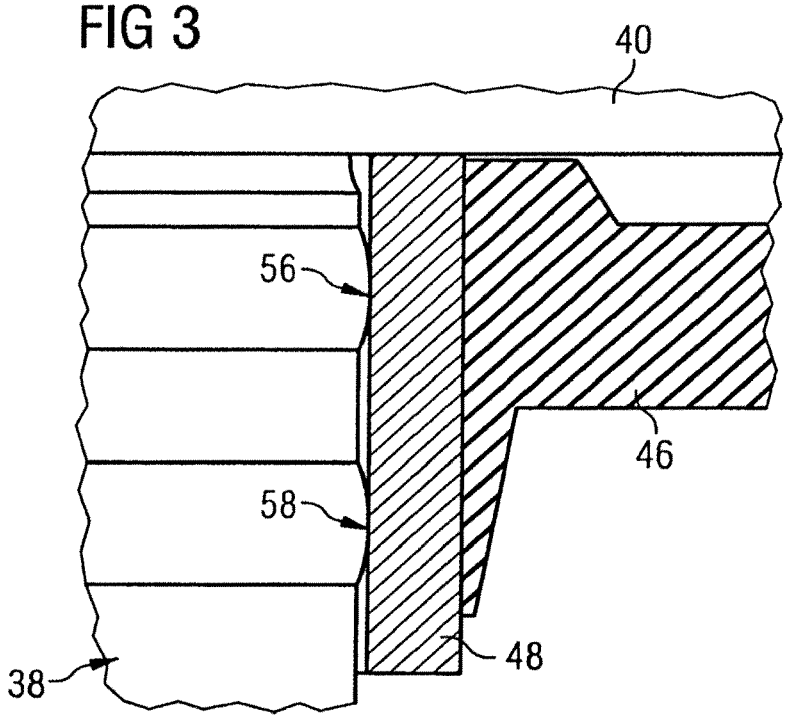
FIG. 3 shows a first embodiment of the compensating element

The friction-fit connection between the inner ring 48 and the piston rod 38 can be established in a particularly simple and effective manner, if the piston rod 38 preferably comprises a first inner protrusion 56 (FIG. 3). The first inner protrusion 56 can alternatively also be designed on the inner ring 48. The first inner protrusion 56 preferably comprises a rounded profile. In the profile, the rounded profile theoretically produces a linear-shaped contact surface between the piston rod 38 and the inner ring 48. This produces an easy plastic or also elastic deformability of the first inner protrusion 56 and of the inner ring 48 and/or of the piston rod 38. Furthermore, the rounded profile of the first inner protrusion 56 allows the sealing element 44 to be easily mounted onto the piston rod 38.

Both the sealing and also the friction-fit effect of the first protrusion 56 can be intensified by a second inner protrusion 58. The second inner protrusion 58 can be embodied on the piston rod 38 and/or on the inner ring 48. In addition to the same advantages which the first inner protrusion 56 has, the additional embodiment of the second inner protrusion 58 provides the opportunity to select the first inner protrusion 56 with its maximum diameter such that during assembly, surface inaccuracies on the inner ring 48 and/or the piston rod 38 in an inner coupling area are compensated for as a result of a plastic deformation. The inner coupling area extends across the entire area on which the inner ring 48 is coupled with the piston rod 38. When the sealing element 44 is mounted onto the piston rod 38, the surface of the first inner protrusion 56 and of the inner ring 48 and/or of the piston rod 38 is first smoothed. A further plastic deformation then occurs during a further assembly by coupling the second inner protrusion 58 with the inner ring 48 and/or piston rod 38. Aside from the first and second inner protrusion 56, 58, further inner protrusions can still also be provided. The inner protrusions can all have the same diameters or also different diameters and can be designed according to the first or second inner protrusion.

Figure 4:
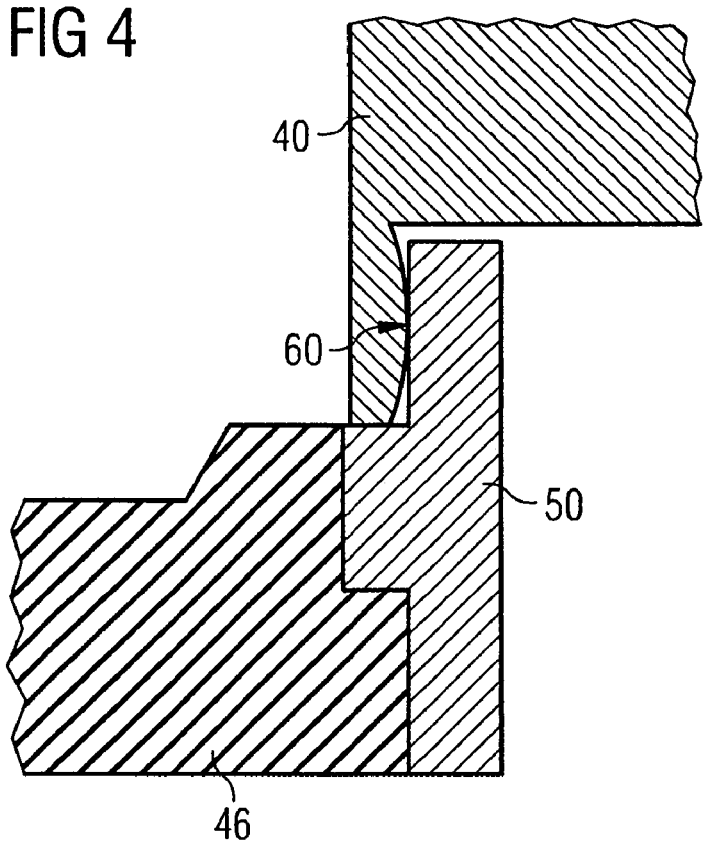
FIG. 4 shows a second embodiment of the compensating element
Figure 5:
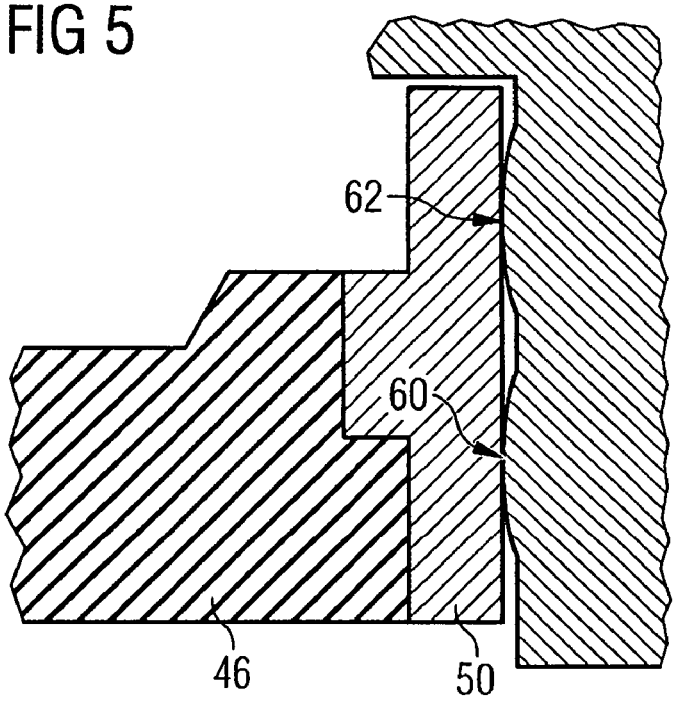
FIG. 5 shows a third embodiment of the compensating element.

Alternatively or in addition, the outer ring 50 with the cup-shaped body 32 (FIG. 4) can be fixed by a friction-fit, preferably by means of a press fit, via a first outer protrusion 60 to the cup-shaped body 32 and/or the outer ring 50. In this case, the outer ring 50 can have both a larger diameter as well as a smaller diameter than the cup-shaped body 32 in an outer coupling area (FIG. 5), in which the cup-shaped body 32 is coupled with the outer ring 50. The first outer protrusion 60 is preferably embodied as a rounded profile. This makes an effective and sealed coupling of the outer ring 50 with the cup-shaped body 32 and additionally an easy assembly of the outer ring 50 on the cup-shaped body 32 possible in a simple manner.

In addition to the first outer protrusion 60 the outer ring 50 and/or the cup-shaped body 32 can comprise a second outer protrusion 62. The second outer protrusion 62 has a larger oversize in respect of the cup-shaped body 32 and/or of the outer ring 50 than the first outer protrusion 60. During an assembly, the first outer protrusion 60 is then first coupled with the cup-shaped body 40 and/or the outer ring 50 and then the second outer protrusion 60.

In addition to the first and second outer protrusion 60, 62, other further inner protrusions can still also be provided. The outer protrusions can all feature the same diameter or also different diameters and can be designed according to the first or second outer protrusions 60, 62.

With a compensating element designed according to DE 103 44 061 A1, a sealing element is fixed with a welding process to be gas-tight on a cup-shaped body. A significant heat, which heats the entire compensating element, develops with this type of welding process. This represents a major restriction in respect of the material selection for the compensating element, the sealing element used therein and in particular the sealing ring. Furthermore, the significant heat development must also be accounted for during the construction of the compensating element of the prior art. Furthermore, the sealing ring can be damaged by the welding process by means of an arc-over. In addition to the expensive and time-consuming welding process, the compensating element must be extensively cleaned after the welding process. Only negligible heat is produced during a friction-fit coupling of the sealing element with the cup-shaped body and/or a piston. This allows a great freedom of design in the construction of the compensating element and in the choice of the materials for the compensating element.

The invention is not restricted to the exemplary embodiments. By way of example, further protrusions can be formed in addition to the protrusions 56, 58, 60, 62. The further protrusions can then be matched to one another in their design, so that an advantageous assembly and coupling is possible. The profile of the protrusions 56, 58, 60, 62 and of the further protrusions can be designed differently. A suitable profile can be triangular for instance. One or a number of edges can also be designed in the profile provided an assembly is further possible. The protrusions 56, 58, 60, 62 can extend in a circular fashion around the coupling areas, they can however also extend around the coupling area in a meandering or zig-zag form. Furthermore, the injection valve can also be provided with a nozzle needle opening inwards or the nozzle needle can be indirectly powered by the piezo actuator 14, via a hydraulic coupling for instance.

What is claimed is:

1. A compensating element for an injection valve, comprising:

a cup-shaped body with a cup-base and a recess;

a piston having an axially extending guide segment making a clearance fit with respect to the recess of the cup-shaped body, the guide segment of the piston arranged at least partially axially moveable with the guide segment in the recess of the cup-shaped body; and a sealing element, which is arranged on the side of the guide segment facing away from the cup base, which couples the cup-shaped body with the piston, wherein a sealed system is delimited by the cup-shaped body, the piston and the sealing element, and wherein the coupling of the sealing element is friction-fit with at least one of the cup-shaped body and the piston;

wherein the sealing element includes an outer ring and an inner ring coupled together by a sealing ring having a greater elasticity than the outer ring and the inner ring; and wherein one of the sealing element outer ring and the cup-shaped body includes at least one first outer protrusion that extends around the entire circumference of an outer coupling area of the sealing element and cup-shaped body, the at least one first outer protrusion of the one of the sealing element outer ring and the cup-shaped body creating an oversize fit with respect to the other one of the sealing element outer ring and the cup-shaped body in the outer coupling area.

2. A compensating element according to claim 1, wherein the one of the sealing element outer ring and the cup-shaped body in the outer coupling area comprises a second outer protrusion, which extends around the entire circumference of the outer coupling area, the second outer protrusion comprising a greater oversize with respect to the other one of the sealing element outer ring and the cup-shaped body.

3. A compensating element according to claim 1, wherein one of the sealing element inner ring and the piston comprises at least one first inner protrusion which extends around the entire circumference of an inner coupling area in which the sealing element is coupling with the piston, wherein the at least one first inner protrusion makes an oversize fit with respect to the other one of the sealing element inner ring and the piston.

4. A compensating element according to claim 3, wherein the one of the sealing element inner ring and the moveable body in the inner coupling area comprises a second inner protrusion, which extends around the entire circumference of the inner coupling area, the second inner protrusion comprising a greater oversize with respect to the other one of the sealing element inner ring and the piston.

5. A compensating element according to claim 1, wherein the at least one first outer protrusion comprises a rounded profile.

6. A compensating element according to claim 1, wherein the piston comprises a piston head comprising the guide segment and a piston rod protruding out of the recess of the cup-shaped body, and wherein the axial end of the piston rod which is facing away from the piston head is outside the sealed system.

7. A compensating element according to claim 6, wherein the sealing element inner ring is coupled with the piston rod.

8. A compensating element according to claim 1, wherein the sealing ring comprises an elastomer.

9. An injection valve comprising a compensating element including:

a cup-shaped body including a cup-base and a recess;

a piston having an axially extending guide segment forming a clearance fit with respect to the recess of the cup-shaped body; and a sealing element arranged on the side of the guide segment facing away from the cup-base, the sealing element coupling the cup-shaped body with the piston such that a sealed system is delimited by the cup-shaped body, the piston, and the sealing element;

wherein the sealing element includes an outer ring and an inner ring coupled together by a sealing ring having a greater elasticity than the outer ring and the inner ring; and wherein one of the sealing element outer ring and the cup-shaped body includes at least one protrusion extending around the circumference of a coupling area of the sealing element and cup-shaped body, the at least one protrusion creatin an oversize fit with respect to the other one of the sealing element outer ring and the cup-shaped body in the coupling area.

10. A compensating element for an injection valve, comprising:

a cup-shaped body with a cup-base and a recess;

a piston comprising having an axially extending guide segment forming a clearance fit with respect to the recess of the cup-shaped body, the piston being arranged at least partially axially moveable in the recess of the cup-shaped body; and a sealing element arranged on the side of the guide segment facing away from the cup base, which couples the cup-shaped body with the piston, wherein a sealed system is delimited by the cup-shaped body, the piston and the sealing element, and wherein the coupling of the sealing element is friction-fit with at least one of the cup-shaped body and the piston;

wherein the sealing element includes an outer ring and an inner ring coupled together by a sealing ring having a greater elasticity than the outer ring and the inner ring; and wherein one of the sealing element outer ring and the cup-shaped body includes at least one first outer protrusion that extends around the entire circumference of an outer coupling area of the sealing element and cup-shaped body, the at least one first outer protrusion of the one of the sealing element outer ring and the cup-shaped body creating an oversize fit with respect to the other one of the sealing element outer ring and the cup-shaped body in the outer coupling area.

11. A compensating element according to claim 10 wherein the one of the sealing element outer ring and the cup-shaped body in the outer coupling area comprise, a second outer protrusion, which extend around the entire circumference of the outer coupling area, the second outer protrusion comprising a greater oversize with respect to the other one of the sealing element outer ring and the cup-shaped body.

12. A compensating element according to claim 10, wherein one of the sealing element inner ring and the piston comprises at least one first inner protrusion which extends around the entire circumference of an inner coupling area in which the sealing element is coupling with the piston, wherein the at least one first inner protrusion makes an oversize fit with respect to the other one of the sealing element inner ring and the piston.

13. A compensating element according to claim 12, wherein the one of the sealing element inner ring and the moveable body in the inner coupling area comprises a second inner protrusion, which extends around the entire circumference of the inner coupling area, the second inner protrusion comprising a greater oversize with respect to the other one of the sealing element inner ring and the piston.

14. A compensating element according to claim 10, wherein the at least one first outer protrusion comprises a rounded profile.

15. A compensating element according to claim 10, wherein the piston comprises a piston head comprising the guide segment and a piston rod protruding out of the recess of the cup-shaped body, and wherein the axial end of the piston rod which is facing away from the piston head is outside the sealed system.

16. A compensating element according to claim 15, wherein the sealing element inner ring is coupled with the piston rod.

* * * * *